US006841043B2

(12) United States Patent
Devoe et al.

(10) Patent No.: US 6,841,043 B2
(45) Date of Patent: Jan. 11, 2005

(54) TRIM HOLD DOWN BOX APPARATUS

(76) Inventors: Shawn S. Devoe, A225 S. Foxmoor Rd., Janesville, WI (US) 53545; Marvin D. Hoekman, 3916 E. Creek Rd., Beloit, WI (US) 53511; Leonard A. Scharlau, 825 8th St., Beloit, WI (US) 53511

( * ) Notice: Subject to any disclaimer, the term of this patent is extended or adjusted under 35 U.S.C. 154(b) by 28 days.

(21) Appl. No.: 10/300,701

(22) Filed: Nov. 20, 2002

(65) Prior Publication Data

US 2004/0094011 A1 May 20, 2004

(51) Int. Cl.[7] ..... D21F 2/00

(52) U.S. Cl. ..... 162/289; 162/286; 162/194; 83/53; 83/56; 83/156

(58) Field of Search ..... 162/289, 286, 162/194, 193; 83/53, 56, 156

(56) References Cited

U.S. PATENT DOCUMENTS 4,175,460 A * 11/1979 McPhail ..... 83/856
4,512,226 A * 4/1985 Juckett ..... 83/56
5,140,880 A 8/1992 Littleton
5,423,947 A 6/1995 Steiner
5,622,601 A * 4/1997 Adams et al. ..... 162/194
6,022,452 A * 2/2000 Caspar ..... 162/286
6,253,983 B1 * 7/2001 Dadd ..... 226/95
6,387,220 B1 * 5/2002 Mohrsen et al. ..... 162/363
6,482,294 B2 * 11/2002 Meschenmoser ..... 162/193
6,494,992 B2 * 12/2002 Mohrsen et al. ..... 162/193

* cited by examiner

*Primary Examiner*—Peter Chin
*Assistant Examiner*—Mark Halpern
(74) *Attorney, Agent, or Firm*—David J. Archer

(57) ABSTRACT

A trim hold down box apparatus is disclosed for assisting in the separation of trim cut from an edge of a sheet by a cutter prior to the sheet being transferred from a forming wire of a forming section to a press section of a paper making machine. The apparatus includes a frame which is adjustably secured to the former and is disposed downstream relative to the cutter. A box cradle is secured to the frame and a trim box is movably connected to the box cradle such that floating of the trim box with the forming wire is permitted. The arrangement is such that the forming wire is disposed between the trim and the trim box. A biasing arrangement extends between the trim box and the box cradle so that biasing of the trim box relative to the forming wire is permitted. The trim box has a first and a second end and the first end of the trim box is connected to a source of partial vacuum. The second end of the trim box cooperates with the forming wire and is disposed in a vicinity of the trim. The arrangement is such that when the first end of the trim box is connected to the source of partial vacuum, separation of the trim from the sheet being transferred into the press section is assisted by the partial vacuum applied to the trim at the second end of the trim box.

18 Claims, 6 Drawing Sheets

TRIM HOLD DOWN BOX APPARATUS

BACKGROUND OF THE INVENTION

1. Field of the Invention

The present invention relates to a trim hold down box apparatus for assisting in the separation of trim cut from an edge of a sheet. More particularly, the present invention relates to a trim hold down box apparatus for assisting in the separation of trim cut from an edge of a sheet by a cutter prior to the sheet being transferred from a forming wire of a forming section to a press section of a paper making machine.

2. Background Information

In the papermaking art a typical papermaking machine will include a forming section where paper stock is ejected as a ribbon onto a moving wire screen where water drains from the paper stock to form a formed web.

The formed web is then transferred from the forming wire or screen into a press section for pressing more water from the web. The press section usually includes a pick up roll which is disposed closely adjacent to a turning roll of the forming section, the pick up roll being provided with vacuum segments for initially transferring a tail cut from the formed web. The tail is then widened until a full width sheet is being transferred from the forming wire to the pick up roll of the press section. However, before transferring the formed web into the press section, it is usual for the formed web to be transported by the forming wire around the turning roll of the forming section where the formed web is released from the forming wire to a couch pit for recycling thereof. Such releasing of the web to the couch pit is continued until the formation of the web on the forming wire has been adequately stabilized. When the web has been stabilized, a cutter disposed upstream from the pick up roll cuts the web in a machine direction so that a narrow trim is removed from the edge of the formed web, with the trim and the remainder of the full width sheet being released to the couch pit. The aforementioned tail is then cut in a machine direction so that on application of vacuum to the pick up roll, the tail will transfer from the forming wire into the press section while the trim continues on the wire to the turning roll for release to the couch pit. However, a problem has existed in prior art forming sections in that although the trim is cut from the web, there exists a tendency for the trim to fail to fully separate from the sheet and for the trim sometimes to be transferred with the sheet into the press section. When such trim extends through the press section, the quality of the resultant paper is compromised and the web often tends to break in the press section thus resulting in lost production.

The present invention overcomes the aforementioned problems by the provision of a trim hold down box apparatus that positively separates the trim from the sheet so that the trim is prevented from being transferred by the pick up roll into the press section.

Therefore, it is a primary feature of the present invention to provide a trim hold down box apparatus that overcomes the problems associated with the prior art arrangements.

Another feature of the present invention is the provision of a trim hold down box apparatus that enables reliable separation of trim from an edge of a sheet when transferring the sheet from a forming section to a press section.

Other features and advantages of the present invention will be readily apparent to those skilled in the art by a consideration of the detailed description of a preferred embodiment of the present invention contained herein.

SUMMARY OF THE INVENTION

The present invention relates to a trim hold down box apparatus for assisting in the separation of trim cut from an edge of a sheet by a cutter prior to the sheet being transferred from a forming wire of a forming section to a press section of a paper making machine. The apparatus includes a frame which is adjustably secured to the forming section and is disposed downstream relative to the cutter. A box cradle is secured to the frame and a trim box is movably connected to the box cradle such that floating of the trim box with the forming wire is permitted. The arrangement is such that the forming wire is disposed between the trim and the trim box. A biasing arrangement extends between the trim box and the box cradle so that biasing of the trim box relative to the forming wire is permitted. The trim box has a first and a second end and the first end of the trim box is connected to a source of partial vacuum. The second end of the trim box cooperates with the forming wire and is disposed in a vicinity of the trim. The arrangement is such that when the first end of the trim box is connected to the source of partial vacuum, separation of the trim from the sheet being transferred into the press section is assisted by the partial vacuum applied to the trim at the second end of the trim box.

In a more specific embodiment of the present invention, the frame includes an elongate support member having a first and a second end. The support member defines a slot which extends between the first and the second end of the support member. A fastening arrangement extends through the slot for movably fastening the support member to the forming section. The arrangement is such that machine directional adjustment of the support member relative to the forming section is permitted by the fastening arrangement.

More particularly, the fastening arrangement includes a first bolt which threadably cooperates with the forming section. A second bolt is spaced from the first bolt and threadably cooperates with the forming section. The arrangement is such that a distance from the first to the second bolt is less than a length of the slot such that when the bolts are released, machine directional movement of the support member relative to the bolts is permitted.

Furthermore, the first end of the support member defines a transverse guideway and a further slot extends through the guideway.

Also, the frame further includes a cross support which has a first and a second extremity. The first extremity of the cross support cooperates with the transverse guideway. Moreover, the cross support defines a transverse slot and a machine directional slot. An anchor extends through the transverse slot, the machine directional slot and the further slot defined by the support member, the anchor threadably cooperating with the forming section so that cross machine directional adjustment of the cross support relative to the support member and the forming section is permitted.

Additionally, the cross support includes a handle for permitting manual movement of the cross support in the cross machine direction when the anchor is released.

The second extremity of the cross support defines a recess for the reception therein of the box cradle.

Furthermore, the second extremity of the cross support is bifurcated such that the second extremity of the cross support includes a first support leg and a second support leg which is disposed spaced and parallel relative to ale first leg. The arrangement is such that the legs adjustably support the box cradle.

An adjuster device extends from the legs to the box cradle for permitting adjustable movement of the box cradle in a cross machine direction.

The box cradle includes a first arm and a second arm which is disposed spaced and parallel relative to the first arm. The arms extend in a machine direction and are selectively movable in a cross machine direction relative to the frame and more particularly, the support legs of the frame.

Additionally, the box cradle includes a first transverse member which extends from a first termination of the first arm to a first side of the second arm. A second transverse member extends from a second termination of the first arm to a second side of the second arm.

Moreover, the trim box has a first and a second side, the trim box including a first extension which extends from the first side of the trim box. A second extension extends from the second side of the trim box. Also, the biasing arrangement extends between the first extension and the box cradle and between the second extension and the box cradle.

More specifically, the biasing arrangement extends between the first extension and the first transverse member. The biasing arrangement also extends between the second extension and the second transverse member.

In a preferred embodiment of the present invention, the biasing arrangement includes a first compression spring which extends between the first extension and the first transverse member. Also, a second compression spring extends between the second extension and the second transverse member.

Furthermore, a lost motion pivot linkage is provided for pivotally securing the second extension relative to the box cradle.

Additionally, the second end of the trim box defines a plurality of openings. The arrangement is structured such that when the forming wire slides over the second end of the trim box, the partial vacuum within the trim box is applied to the forming wire through the plurality of openings so that the trim disposed on and moving with the forming wire is positively separated from the edge of the sheet for removal thereof to a couch pit subsequent to the trim parting from the forming wire.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
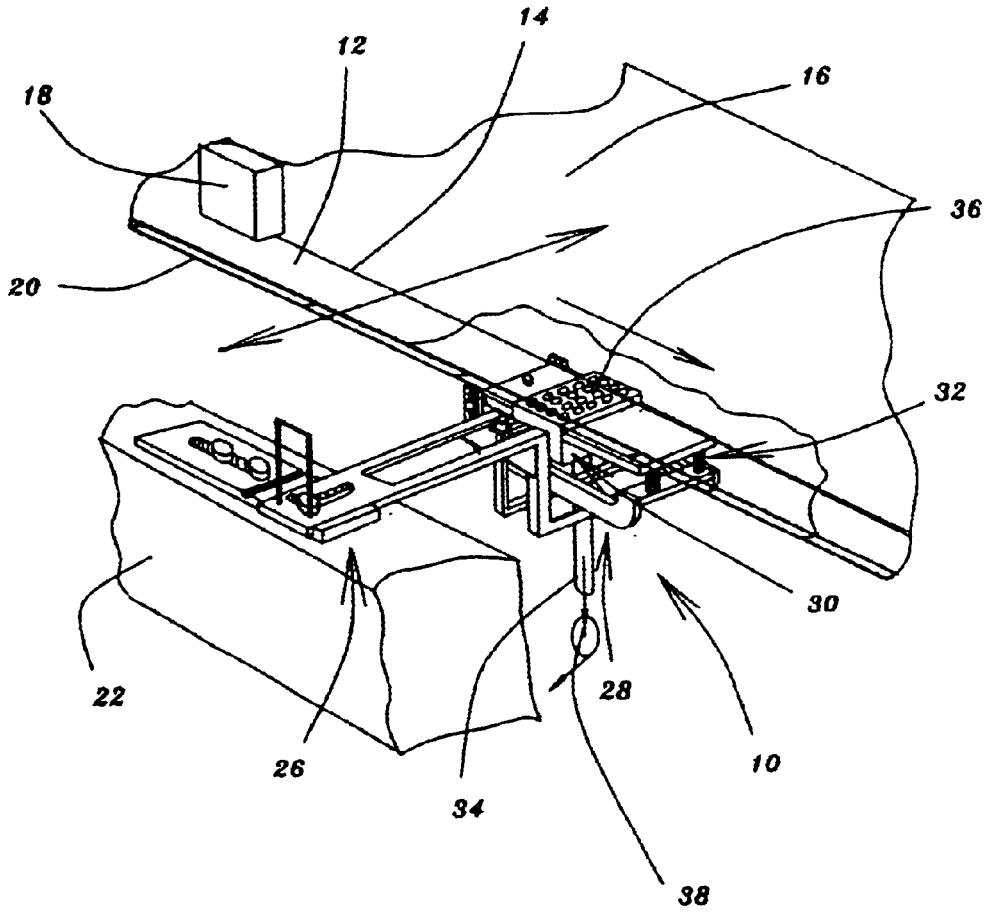
FIG. 1 is a perspective view of a trim hold down box apparatus according to the present invention.

FIG. 1 is a perspective view of a trim hold down box apparatus generally designated 10 according to the present invention. As shown in FIG. 1, the apparatus 10 is provided for assisting in the separation of trim 12 cut from an edge 14 of a sheet 16 by a cutter 18 prior to the sheet 16 being transferred from a forming wire 20 of a forming section 22 to a press section 24 to be described hereinafter of a paper making machine.

The apparatus 10 includes a frame generally designated 26 which is adjustably secured to the forming section or former 22 and is disposed downstream relative to the cutter 18. A box cradle generally designated 28 is secured to the frame 26 and a trim box generally designated 30 is movably connected to the box cradle 28 such that floating of the trim box 30 with the forming wire 20 is permitted. The arrangement is such that the forming wire 20 is disposed between the trim 12 and the trim box 30. A biasing arrangement generally designated 32 extends between the trim box 30 and the box cradle 28 so that biasing of the trim box 30 relative to the forming wire 20 is permitted. The trim box 30 has a first and a second end 34 and 36 respectively and the first end 34 of the trim box 30 is connected to a source of partial vacuum 38. The second end 36 of the trim box 30 cooperates with the forming wire 20 and is disposed in a vicinity of the trim 12. The second end 36 of the trim box 30 defines a plurality of holes or slots or is otherwise porous. The arrangement is such that when the first end 34 of the trim box 30 is connected to the source of partial vacuum 38, separation of the trim 12 from the sheet 16 being, transferred into the press section 24 is assisted by the partial vacuum applied to the trim 12 at the second end 36 of the trim box 30.

Figure 2:
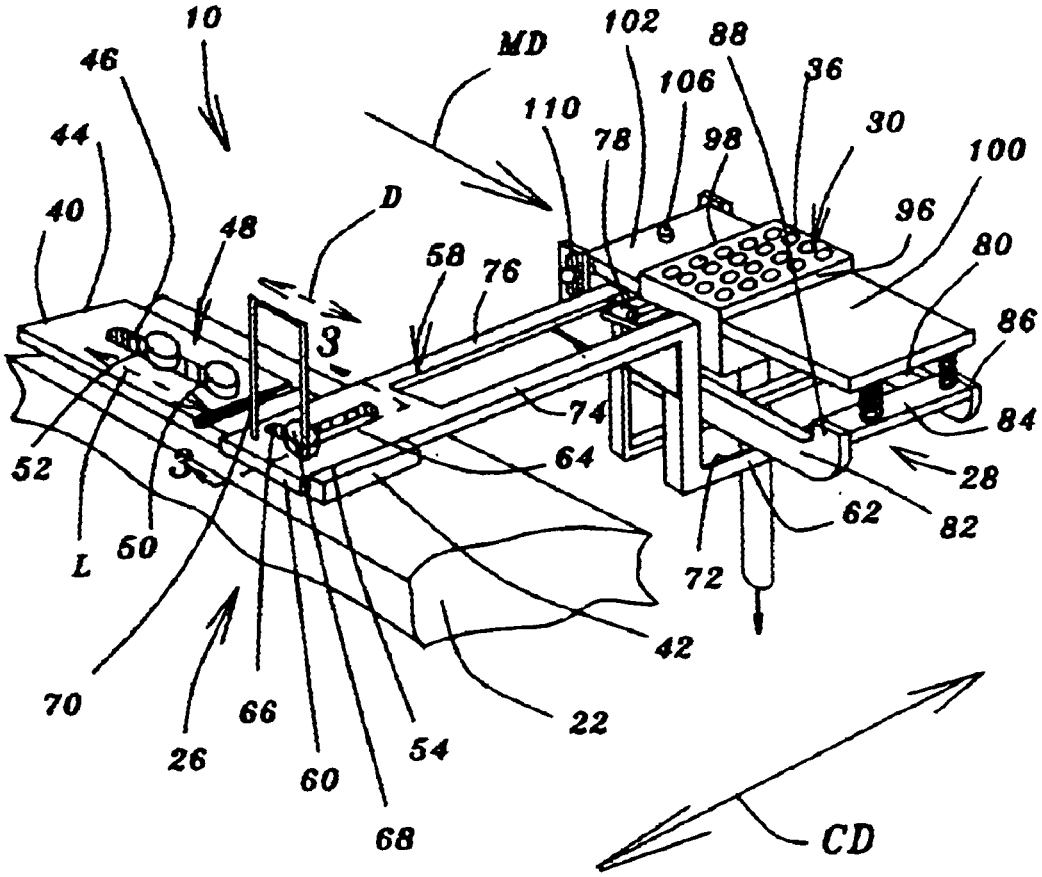
FIG. 2 is an enlarged view of the trim hold down box apparatus shown in FIG. 1.

FIG. 2 is an enlarged view of the trim hold down box apparatus 10 shown in FIG. 1. As shown in FIG. 2, the frame 26 includes an elongate support member 40 having a first and a second end 42 and 44 respectively. The support member 40 defines a slot 46 which extends between the first and the second end 42 and 44 of the support member 40. A fastening arrangement generally designated 48 extends through the slot 46 for movably fastening the support member 40 to the forming section 22. The arrangement is such that machine directional adjustment as indicated by the arrow MD of the support member 40 relative to the forming section 22 is permitted by the fastening arrangement 48.

More particularly, the fastening arrangement 48 includes a first bolt 50 which threadably cooperates with the forming section 22. A second bolt 52 is spaced from the first bolt 50 and threadably cooperates with the forming section 22. The arrangement is such that a distance D from the first to the second bolt 50 and 52 respectively is less than a length L of the slot 46 such that when the bolts 50 and 52 are released, machine directional movement MD of the support member 40 relative to the bolts 50 and 52 is permitted.

Furthermore, the first end 42 of the support member 40 defines a transverse guideway 54 and a further slot extends through the guideway 54.

Also, the frame further includes a cross support generally designated 58 which has a first and a second extremity 60 and 62 respectively. The first extremity 60 of the cross support 58 cooperates with the transverse guideway 54. Moreover, the cross support 58 defines a transverse slot 64 and a machine directional slot 66. An anchor 68 extends through the transverse slot 64, the machine directional slot 66 and the further slot defined by the support member 40, the anchor 68 threadably cooperating with the forming section 22 so that cross machine directional adjustment as indicated by the arrow CD, of the cross support 58 relative to the support member 40 and the forming section 22 is permitted.

Additionally, the cross support 58 includes a handle 70 for permitting manual movement of the cross support 58 in the cross machine direction CD when the anchor 68 is released.

Figure 3:
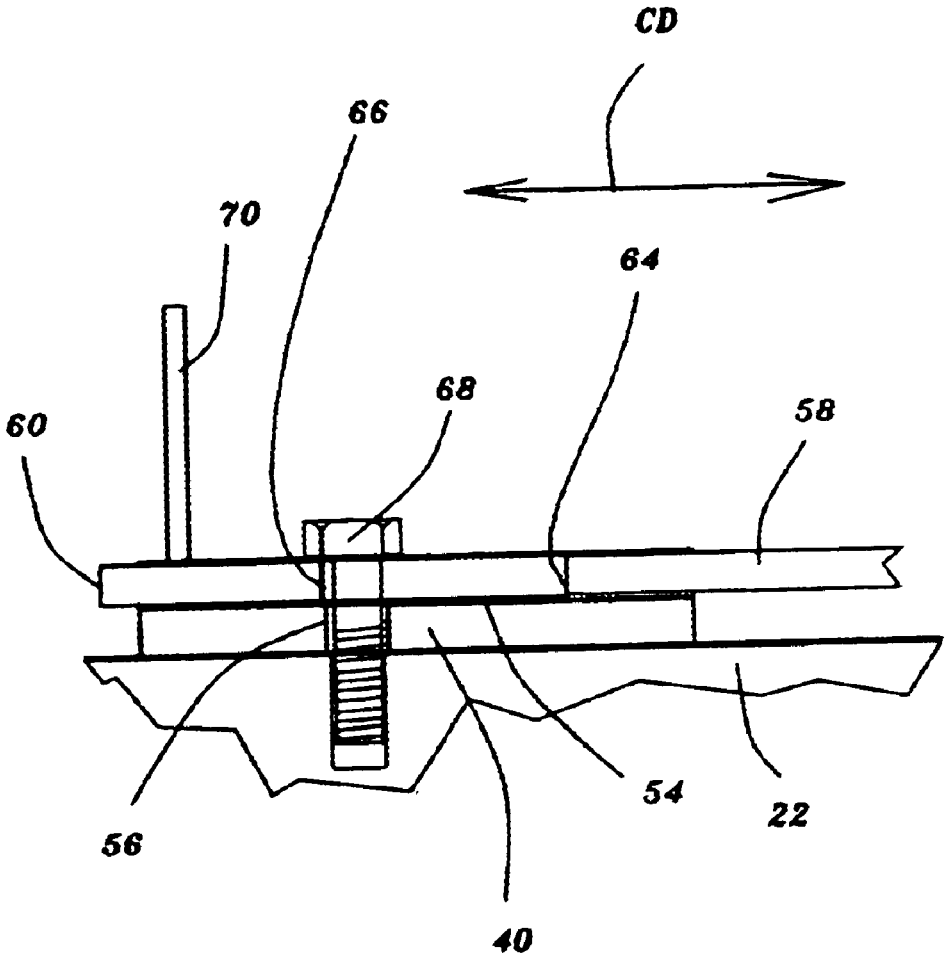
FIG. 3 is an enlarged sectional view taken on the line 3—3 of FIG. 2.

FIG. 3 is an enlarged sectional view taken on the line 3—3 of FIG. 2. As shown in FIG. 3, the anchor 68 extends through the transverse slot 64, the machine directional slot 66 and the further slot 56 defined by the support member 40 and threadably engages the forming section 22 for permitting cross machine directional adjustment CD of the cross support 58.

As shown in FIG. 2, the second extremity 62 of the cross support 58 defines a recess 72 for the reception therein of the box cradle 28.

Furthermore, the second extremity 62 of the cross support 58 is bifurcated such that the second extremity 62 of the cross support 58 includes a first support leg 74 and a second support leg 76 which is disposed spaced and parallel relative to the first leg 74. The arrangement is such that the legs 74 and 76 respectively adjustably support the box cradle 28.

An adjuster device 78 extends from the legs 74 and 76 to the box cradle 28 for permitting adjustable movement of the box cradle 28 in a cross machine direction CD.

The box cradle 28 includes a first arm 80 and a second arm 82 which is disposed spaced and parallel relative to the first arm 80. The arms 80 and 82 respectively extend in a machine direction MD and are selectively movable in a cross machine direction CD relative to the frame 26 and more particularly, the support legs 74 and 76 respectively of the frame 26.

Additionally, the box cradle 28 includes a first transverse member 84 which extends from a first termination 86 of the first arm 80 to a first side 88 of the second arm 82.

Figure 4:
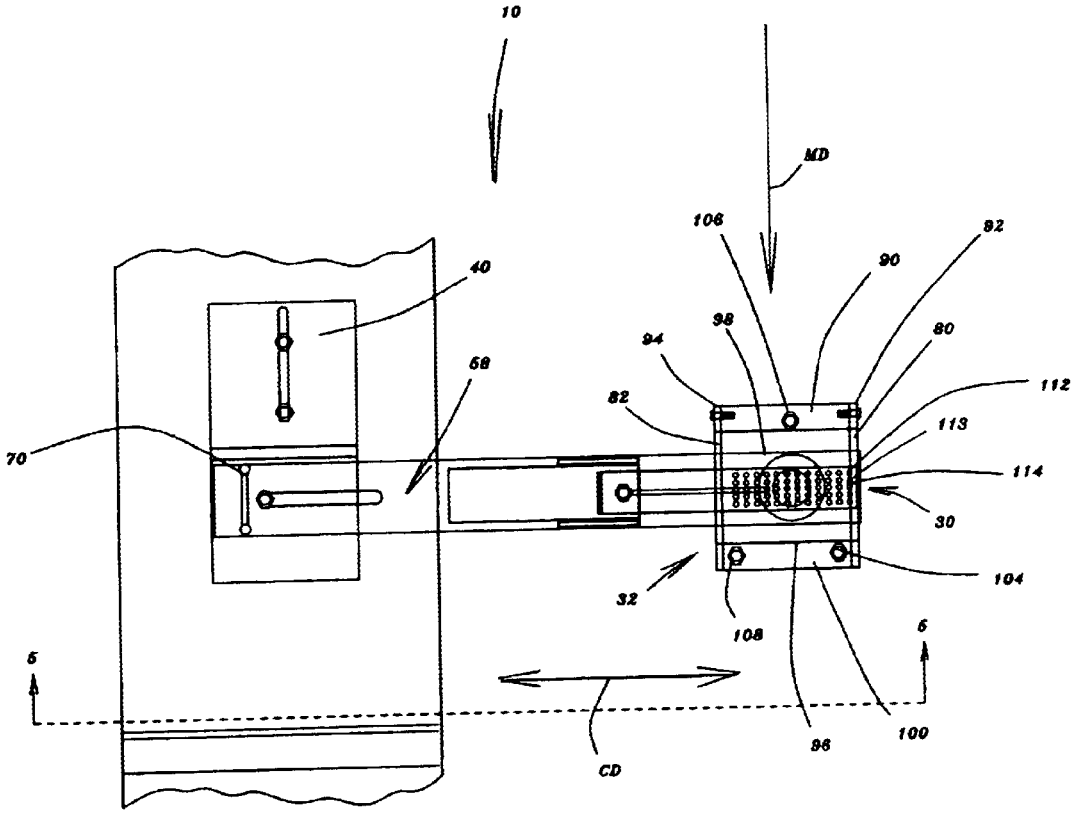
FIG. 4 is a top plan view of the trim hold down apparatus shown in FIGS. 1–3.

FIG. 4 is a top plan view of the apparatus 10 shown in FIGS. 1–3. As shown in FIG. 4, a second transverse member 90 extends from a second termination 92 of the first arm 80 to a second side 94 of the second arm 82.

Moreover, the trim box 30 has a first and a second side 96 and 98 respectively, the trim box 30 including a first extension 100 which extends from the first side 96 of the trim box 30. A second extension 102 extends from the second side 98 of the trim box 30. Also, the biasing arrangement 32 extends between the first extension 100 and the box cradle 28 and between the second extension 102 and the box cradle 28 as shovel in FIG. 2.

More specifically, the biasing arrangement 32 extends between the first extension 100 and the first transverse member 84. The biasing arrangement 32 also extends between the second extension 102 and the second transverse member 90.

Figure 5:
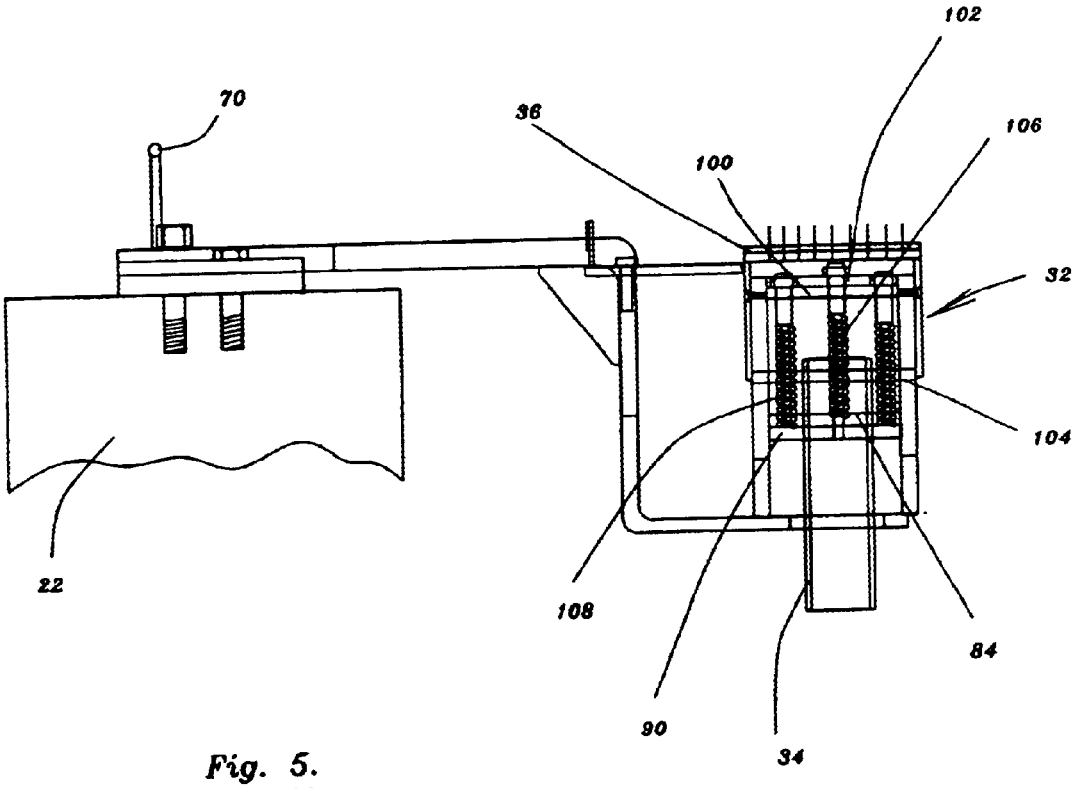
FIG. 5 is a view taken on the line 5—5 of FIG. 4.

FIG. 5 is a view taken on the line 5—5 of FIG. 4. As shown in FIG. 5, the biasing arrangement 32 includes a first compression spring 104 which extends between the first extension 100 and the first transverse member 84. Also, a second compression spring 106 extends between the second extension 102 and the second transverse member 90 shown in FIG. 4. Also a further spring 108 extends between the first extension 100 and the first transverse member 84.

Furthermore, as shown in FIG. 2, a lost motion pivot linkage 110 is provided for pivotally securing the second extension 102 relative to the box cradle 28.

Additionally, the second end 36 of the trim box 30 defines a plurality of openings 112, 113 and 114 as shown in FIG. 4. The arrangement is structured such that when the forming wire 20 slides over the second end 36 of the trim box 30, the partial vacuum within the trim box 30 is applied to the forming wire 20 through the plurality of openings 112–114 so that the trim 12 disposed on and moving with the forming wire 20 is positively separated from the edge 14 of the sheet 16 for removal thereof to a couch pit (not shown) subsequent to the trim 12 parting from the forming wire 20.

Figure 6:
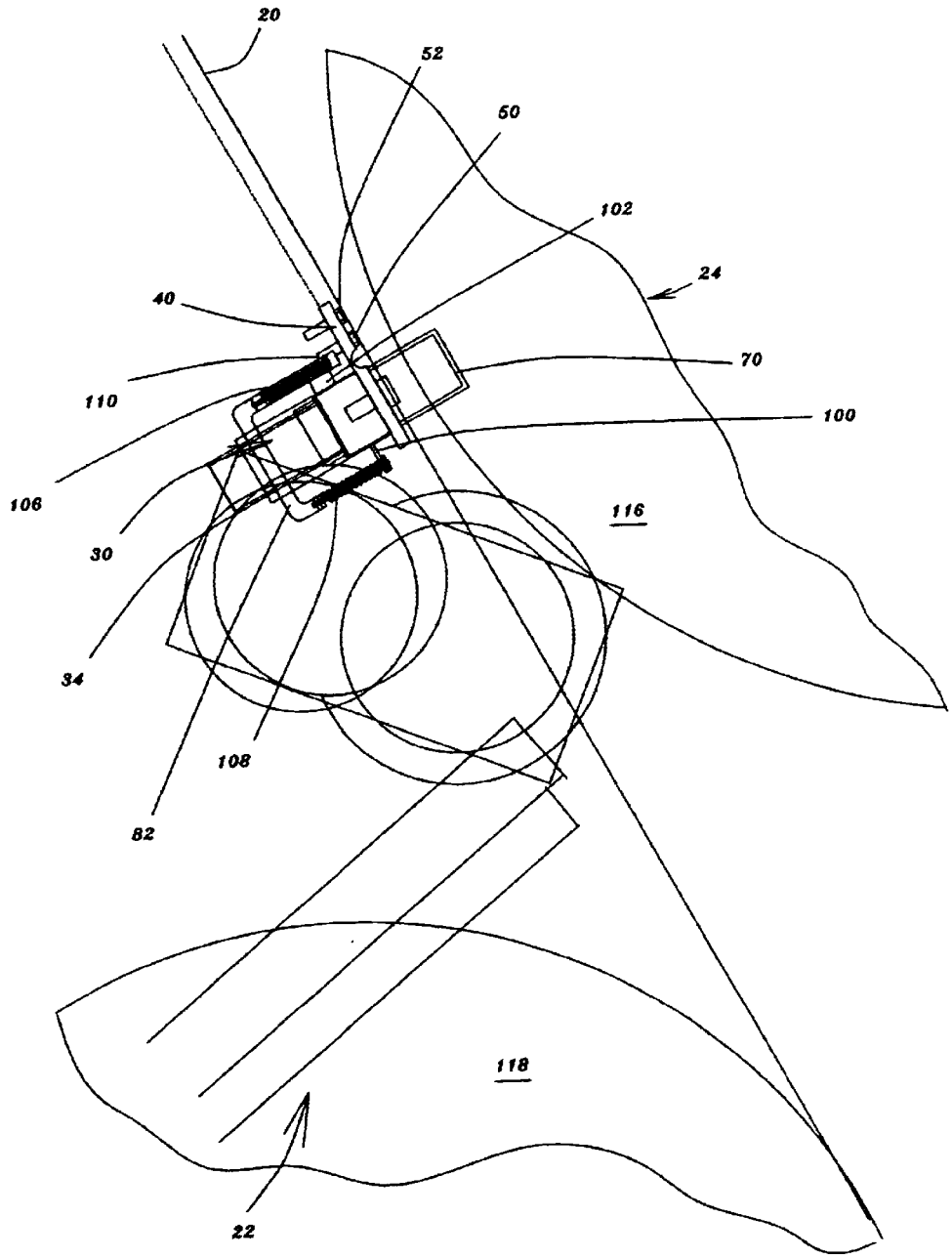
FIG. 6 is side elevational view of the apparatus shown in FIG. 1.

FIG. 6 is side elevational view of the apparatus 10 shown in FIG. 1 but shows the forming wire 20 extending past a pick up roll 116 of the press section 24 and extending over the trim box 30 to a turning roll 118 of the forming section 22.

In operation of the apparatus according to the present invention, the trim box 30 is adjusted to the correct machine direction and cross machine direction dispositions by releasing the bolts 50 and 52 and the anchor 68. The machine direction disposition is attained by sliding the support member to the correct disposition and tightening the bolts 50 and 52. The cross support 58 is then urged by the handle 70 so that the cross support 58 slides within the guideway 54 until the correct cross machine direction disposition for the trim box is achieved. The anchor 68 is then tightened to lock the support member 40 and cross support 58 at the set locations. Further adjustment of the cross machine disposition of the box cradle 28 relative to the cross support 58 is achieved by the adjusting device 78 which locks the cradle 28 to the cross support 58. Vacuum is applied to the first end 34 of the trim box 30 which is spring mounted on the cradle 28 by the compression springs 104, 108 and 106. The lost motion pivot linkage 110 permits the second end 36 of the trim box 30 to tilt in order to accommodate changes in the running direction of the forming wire and the springs lightly urging the second end 36 of the box 30 against the forming wire avoids any tendency for the box 30 to penetrate into the forming wire 20. The plurality of openings 112–114 assure that the vacuum is applied through the forming wire 20 so that the trim 12 will be predictably separated from the sheet for subsequent release thereof to the couch pit.

The present invention provides an apparatus that reliably causes separation of trim from a sheet prior a transfer of the sheet to a press section.

What is claimed is:

1. A trim hold down box apparatus connected to a source of partial vacuum for assisting in the separation of trim cut from an edge of a sheet by a cutter prior to the sheet being transferred from a forming wire of a forming section to a press section of a paper making machine, said apparatus comprising:

a frame adjustably secured to the former and disposed downstream relative to the cutter;

a box cradle secured to said frame;

a trim box movably connected to said box cradle such that floating of said trim box with the forming wire is permitted, the forming wire being disposed between the trim and said trim box;

a biasing arrangement extending between said trim box and said box cradle so that biasing of said trim box relative to the forming wire is permitted; and said trim box having a first and a second end, said first end of said trim box being connected to a the source of partial vacuum, said second end of said trim box cooperating with the forming wire and being disposed in a vicinity of the trim so that when said first end of said trim box is connected to the source of partial vacuum, separation of the trim from the sheet being transferred into the press section is assisted by the partial vacuum applied to the trim at said second end of said trim box.

2. A trim hold down box apparatus as set forth in claim 1 wherein said frame includes:

an elongate support member having a first and a second end, said support member defining a slot which extends between said first and said second end of said support member;

a fastening arrangement extending through said slot for movably fastening said support member to the forming section, the arrangement being such that machine directional adjustment of said support member relative to the forming section is permitted by said fastening arrangement.

3. A trim hold down box apparatus as set forth in claim 2 wherein said fastening arrangement includes:

a first bolt threadably cooperating with the forming section;

a second bolt spaced from said first bolt, said second bolt threadably cooperating with the forming section, the arrangement being such that a distance from said first to said second bolt is less than a length of said slot such that when said bolts are released, machine directional movement of said support member relative to said bolts is permitted.

4. A trim hold down box apparatus as set forth in claim 2 wherein said first end of said support member defines a transverse guideway and a further slot extending through said guideway;

said frame further including:

a cross support having a first and a second extremity, said first extremity of said cross support cooperating with said transverse guideway, said cross support defining a transverse slot and a machine directional slot;

an anchor extending through said transverse slot, said machine directional slot and said further slot defined by said support member, said anchor threadably cooperating with the forming section so that cross machine directional adjustment of said cross support relative to said support member and the forming section is permitted.

5. A trim hold down box apparatus as set forth in claim 4 wherein said cross support includes:

a handle for permitting manual movement of said cross support in the cross machine direction when said anchor is released.

6. A trim hold down box apparatus as set forth in claim 4 wherein said second extremity of said cross support defines a recess for the reception therein of said box cradle.

7. A trim hold down box apparatus as set forth in claim 6 wherein said second extremity of said cross support is bifurcated such that said second extremity of said cross support includes:

a first support leg;

a second support leg disposed spaced and parallel relative to said first leg, the arrangement being such that said legs adjustably support said box cradle.

8. A trim hold clown box apparatus as set forth in claim 7 further including:

an adjuster device extending from said legs to said box cradle for permitting adjustable movement of said box cradle in a cross machine direction.

9. A trim hold down box apparatus as set forth in claim 7 wherein said box cradle includes:

a first arm having a first and a second termination;

a second arm having a first and a second side, said second arm being disposed spaced and parallel relative to said first arm, said arms extending in a machine direction and being selectively movable in a cross machine direction relative to said support legs.

10. A trim hold down box apparatus as set forth in claim 9 wherein said box cradle further includes:

a first transverse member extending from said first termination of said first arm to said first side of said second arm;

a second transverse member extending from said second termination of said first arm to said second side of said second arm.

11. A trim hold down box apparatus as set forth in claim 10 wherein said trim box has a first and a second side, said trim box including:

a first extension extending from said first side of said trim box;

a second extension extending from said second side of said trim box;

said biasing arrangement extending between said first extension and said first transverse member, said biasing arrangement also extending between said second extension and said second transverse member.

12. A trim hold down box apparatus as set forth in claim 11 wherein said biasing arrangement includes:

a first compression spring extending between said first extension and said first transverse member;

a second compression spring extending between said second extension and said second transverse member.

13. A trim hold down box apparatus as set forth in claim 12 further including:

a lost motion pivot linkage for pivotally securing the second extension relative to the box cradle.

14. A trim hold down box apparatus as set forth in claim 1 wherein said box cradle includes:

a first arm;

a second arm disposed spaced and parallel relative to said first arm, said arms extending in a machine direction and being selectively movable in a cross machine direction relative to said frame.

15. A trim hold down box apparatus as set forth in claim 1 wherein said trim box has a first and a second side, said trim box including:

a first extension extending from said first side of said trim box;

a second extension extending from said second side of said trim box;

said biasing arrangement extending between said first extension and said box cradle, said biasing arrangement also extending between said second extension and said box cradle.

16. A trim hold down box apparatus as set forth in claim 1 wherein said second end of said trim box defines a plurality of openings such that when the forming wire slides over said second end of said trim box, the partial vacuum within said trim box is applied to the forming wire through said plurality of openings so that the trim disposed on and moving with the forming wire is positively separated from the edge of the sheet for removal thereof to a couch pit subsequent to the trim parting from the forming wire.

17. A trim hold down box apparatus connected to a source of partial vacuum for assisting in the separation of trim cut from an edge of a sheet by a cutter prior to the sheet being transferred from a forming wire of a forming section to a press section of a paper making machine, said apparatus comprising:

a frame adjustably secured to the former and disposed downstream relative to the cutter;

a box cradle secured to said frame;

a trim box movably connected to said box cradle such that floating of said trim box with the forming wire is permitted, the forming wire being disposed between the trim and said trim box;

a biasing arrangement extending between said trim box and said box cradle so that biasing of said trim box relative to the forming wire is permitted;

said trim box having a first and a second end, said first end of said trim box being connected to the source of partial vacuum, said second end of said trim box cooperating with the forming wire and being disposed in a vicinity of the trim so that when said first end of said trim box is connected to the source of partial vacuum, separation of the trim from the sheet being transferred into the press section is assisted by the partial vacuum applied to the trim at said second end of said trim box;

said frame including:

an elongate support member having a first and a second end, said support member defining a slot which extends between said first and said second end of said support member; and a fastening arrangement extending through said slot for movably fastening said support member to the forming section, the arrangement being such that machine directional adjustment of said support member relative to the forming section is permitted by said fastening arrangement.

18. A trim hold down box apparatus connected to a source of partial vacuum for assisting in the separation of trim cut from an edge of a sheet by a cutter prior to the sheet being transferred from a forming wire of a forming section to a press section of a paper making machine, said apparatus comprising:

a frame adjustably secured to the former and disposed downstream relative to the cutter;

a box cradle secured to said frame;

a trim box movably connected to said box cradle such that floating of said trim box with the forming wire is permitted, the forming wire being disposed between the trim and said trim box;

a biasing arrangement extending between said trim box and said box cradle so that biasing of said trim box relative to the forming wire is permitted;

said trim box having a first and a second end, said first end of said trim box being connected to the source of partial vacuum, said second end of said trim box being porous and cooperating with the forming wire and being disposed in a vicinity of the trim so that when said first end of said trim box is connected to the source of partial vacuum, separation of the trim from the sheet being transferred into the press section is assisted by the partial vacuum applied to the trim at said second end of said trim box;

said frame including:

an elongate support member having a first and a second end, said support member defining a slot which extends between said first and said second end of said support member;

a fastening arrangement extending through said slot for movably fastening said support member to the forming section, the arrangement being such that machine directional adjustment of said support member relative to the forming section is permitted by said fastening arrangement;

said fastening arrangement including:

a first bolt threadably cooperating with the forming section;

a second bolt spaced from said first bolt, said second bolt threadably cooperating with the forming section, the arrangement being such that a distance from said first to said second bolt is less than a length of said slot such that when said bolts are released, machine directional movement of said support member relative to said bolts is permitted;

said first end of said support member defining a transverse guideway and a further slot extending through said guideway;

said frame further including:

a cross support having a first and a second extremity, said first extremity of said cross support cooperating with said transverse guideway, said cross support defining a transverse slot and a machine directional slot;

an anchor extending through said transverse slot, said machine directional slot and said further slot defined by said support member, said anchor threadably cooperating with the forming section so that cross machine directional adjustment of said cross support relative to said support member and the forming section is permitted;

said cross support including:

a handle for permitting manual movement of said cross support in the cross machine direction when said anchor is released;

said second extremity of said cross support defining a recess for the reception therein of said box cradle;

said second extremity of said cross support being bifurcated such that said second extremity of said cross support includes:

a first support leg;

a second support leg disposed spaced and parallel relative to said first leg, the arrangement being such that said legs adjustably support said box cradle;

an adjuster device extending from said legs to said box cradle for permitting adjustable movement of said box cradle in a cross machine direction;

said box cradle including:

a first arm;

a second arm disposed spaced and parallel relative to said first arm, said arms extending in a machine direction and being selectively movable in a cross machine direction relative to said support legs;

said first aim having a first and a second termination;

said second arm having a first and a second side;

said box cradle further including:

a first transverse member extending from said first termination of said first arm to said first side of said second arm;

a second transverse member extending from said second termination of said first arm to said second side of said second arm;

said trim box having a first and a second side, said trim box including:

a first extension extending from said first side of said trim box;

a second extension extending from said second side of said trim box;

said biasing arrangement extending between said first extension and said first transverse member, said biasing arrangement also extending between said second extension and said second transverse member;

said biasing arrangement including:

a first compression spring extending between said first extension and said first transverse member;

a second compression spring extending between said second extension and said second transverse member;

said trim hold down box apparatus further including:

a lost motion pivot linkage for pivotally securing said second extension relative to said box cradle; and said second end of said trim box defining a plurality of openings such that when the forming wire slides over said second end of said trim box, the partial vacuum within said trim box is applied to the forming wire through said plurality of openings so that the trim disposed on and moving with the forming wire is positively separated from the edge of the sheet for removal thereof to a couch pit subsequent to the trim parting from the forming wire.

* * * * *

UNITED STATES PATENT AND TRADEMARK OFFICE

CERTIFICATE OF CORRECTION

PATENT NO. : 6,841,043 B2
DATED : January 11, 2005
INVENTOR(S) : Shawn S. Devoe et al.

It is certified that error appears in the above-identified patent and that said Letters Patent is hereby corrected as shown below:

Column 2,
Line 62, delete “ale” and substitute therefore -- the --

Column 5,
Line 45, delete “shovel” and substitute therefore -- shown --

Column 11,
Line 5, delete “aim” and substitute therefore -- arm --

Signed and Sealed this

Twelfth Day of April, 2005

JON W. DUDAS
*Director of the United States Patent and Trademark Office*